US008888090B2

(12) United States Patent
Chen et al.

(10) Patent No.: US 8,888,090 B2
(45) Date of Patent: Nov. 18, 2014

(54) SWITCHABLE NOTE-PICKING DEVICE

(75) Inventors: Baisong Chen, Guangzhou (CN); En Wu, Guangzhou (CN); Dong Tan, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 13/811,083

(22) PCT Filed: Oct. 25, 2011

(86) PCT No.: PCT/CN2011/081232

§ 371 (c)(1),
(2), (4) Date: Jan. 18, 2013

(87) PCT Pub. No.: WO2012/075861

PCT Pub. Date: Jun. 14, 2012

(65) Prior Publication Data

US 2013/0241138 A1 Sep. 19, 2013

(30) Foreign Application Priority Data

Dec. 10, 2010 (CN) ..... 2010 1 0582574

(51) Int. Cl.
*B65H 3/06* (2006.01)
*B65H 3/54* (2006.01)
*G07D 11/00* (2006.01)

(52) U.S. Cl.
CPC ..... *B65H 3/0638* (2013.01); *B65H 3/063* (2013.01); *B65H 3/0684* (2013.01); *B65H 3/54* (2013.01); *G07D 11/0024* (2013.01); *B65H 2301/42322* (2013.01); *B65H 2701/1912* (2013.01)
USPC ..... 271/117; 271/165; 271/114; 271/23

(58) Field of Classification Search
USPC ..... 271/23, 35, 165, 114, 117, 131, 138, 271/139, 142; 194/206, 207; 209/534
See application file for complete search history.

(56) References Cited

U.S. PATENT DOCUMENTS 3,506,258 A * 4/1970 Lindquist ..... 271/119
3,514,098 A 5/1970 Ostwald (Continued)

FOREIGN PATENT DOCUMENTS

CN 1129874 C 12/2003
CN 1861505 A 11/2006

(Continued)

OTHER PUBLICATIONS

International Search Report Dated Jan. 19, 2012 from corresponding International Application No. PCT/CN2011/081232.

(Continued)

*Primary Examiner* — Thomas Morrison
(74) *Attorney, Agent, or Firm* — Wolf, Greenfield & Sacks, P.C.

(57) ABSTRACT

A switchable note-picking device (1) used at a note inlet of a note processing device comprises a note-bearing platform (17), a note-picking mechanism (13) for picking notes on the note-bearing platform (17) and a note-classifying mechanism (11) for classifying the picked notes. The note-classifying mechanism (11) comprises a note-classifying shaft (112) and a note-classifying wheel fixed on the note-classifying shaft (112). The switchable note-picking device (1) further comprises a driving component (15) for driving the note-picking mechanism (13) hidden below the note-bearing platform (17) to be exposed out of the note-bearing platform (17) and contact with the notes. By the driving component (15), the note-picking mechanism (13) is exposed out of the note-bearing platform (17) when picking notes and hidden below the note-bearing platform (17) when being free from picking notes, so that the switchable note-picking device (1) can stop deposition and deposit a specified amount of notes.

6 Claims, 9 Drawing Sheets

(56) References Cited

U.S. PATENT DOCUMENTS

| | | | | | |
|---|---|---|---|---|---|
| 4,061,329 | A | * | 12/1977 | Sachuk et al. | 271/10.09 |
| 4,305,525 | A | | 12/1981 | Weigel | |
| 5,184,811 | A | * | 2/1993 | Sardella et al. | 271/10.11 |

FOREIGN PATENT DOCUMENTS

| | | | | |
|---|---|---|---|---|
| CN | 101211479 | A | | 7/2008 |
| CN | 101465016 | A | | 6/2009 |
| CN | 101783038 | A | | 7/2010 |
| CN | 102063760 | A | | 5/2011 |
| JP | 60-87136 | | * | 5/1985 |
| JP | H0692479 | A | | 4/1994 |
| JP | 2005212910 | A | | 8/2005 |
| WO | WO 88/02735 | A1 | | 4/1988 |

OTHER PUBLICATIONS

European Search Report dated Feb. 14, 2014 from corresponding European Application No. 11846992.3.

* cited by examiner

SWITCHABLE NOTE-PICKING DEVICE

The present application is the U.S. National Phase of International Application No. PCT/CN2011/081232, titled "SWITCHABLE NOTE-PICKING DEVICE", filed on Oct. 25, 2011, which claims the benefit of priority to Chinese patent application No. 201010582574.6 titled "A DISPLACABLE BANKNOTE PICKING UP DEVICE", filed with the Chinese State Intellectual Property Office on Dec. 10, 2010. The entire disclosure thereof is incorporated herein by reference.

TECHNICAL FIELD OF THE INVENTION

The present invention relates to a banknote picking up device, particular to a to displaceable banknote picking up device.

BACKGROUND OF THE INVENTION

With the continuous economic development and the growth of the financial industry, there are higher and higher requirements on the general performance, such as the quantity, the quality and the safety, of automatic teller machines applied in the financial industry. To adapt the rapid development of the financial industry, corresponding improvements are made to the automatic teller machines applied in the financial industry to satisfy the future development of the financial industry. However, a banknote picking up device of the automatic teller machine in the market generally has the following disadvantages.

At present, a banknote picking up mechanism and a banknote separating mechanism in the banknote picking up device of the automatic teller machine in the market are driven by a same banknote separating and picking up motor. In the case that a customer puts a stack of banknotes in the automatic teller machine but only wants to deposit 100 pieces of banknotes, when the hundredth banknote enters into a banknote separating wheel of the banknote separating mechanism, on one hand, if the banknote separating and picking up motor is stopped, the hundredth banknote will lose the power and stay in the banknote separating wheel, which will lead to banknotes loss and bring risk to the property of the customer; on the other hand, if the banknote separating and picking up motor still operates, extra banknotes will enter the banknote separating mechanism, thus a specific number of banknotes cannot be deposited, thereby the individual requirement of the customer cannot be satisfied.

Likewise, as to other self-service equipment for processing sheet medium, it also cannot provide the service of depositing a specific number of sheet medium and suspending deposit for the customer.

Therefore, there is an urgent need to provide a displaceable banknote picking up device being capable of depositing a specific number of banknotes to satisfy the individual requirement of the customer on one hand and suspending banknote deposit to ensure the safety of property on the other hand.

SUMMARY OF THE INVENTION

The object of the present application is to provide a displacable banknote picking up device being capable of depositing a specific number of banknotes to satisfy the individual requirement of a customer on one hand and suspending banknote deposit to ensure the safety of property on the other hand.

For realizing the above object, the present application provides a displacable banknote picking up device provided in a banknote inlet of a banknote processing device. The displacable banknote picking up device includes a banknote holding platform, a banknote picking up mechanism for picking up banknotes on the banknote holding platform and a banknote separating mechanism for separating the picked banknotes. The banknote separating mechanism includes a banknote separating shaft and a banknote separating wheel fixed on the banknote separating shaft. The displacable banknote picking up device further includes a driving assembly for driving the banknote picking up mechanism hidden below the banknote holding platform to be exposed above the banknote holding platform and to contact with the banknotes.

Preferably, the displacable banknote picking up device further includes a banknote pressing mechanism for pressing the banknotes on the banknote holding platform such that the banknotes on the banknote holding platform may be stacked more orderly.

Preferably, the banknote pressing mechanism includes a banknote pressing slide shaft, a banknote pressing plate slidably provided on the banknote pressing slide shaft and a banknote pressing plate driving mechanism for providing sliding power to the banknote pressing plate. The banknote pressing mechanism with the above structure is simpler and more compact.

Preferably, the banknote picking up mechanism includes a banknote picking up wheel bracket, a banknote picking up wheel shaft rotatably connected with the banknote picking up wheel bracket and at least one banknote picking up wheel fixed on the banknote picking up wheel shaft, the banknote picking up wheel bracket is rotatably connected with the banknote separating shaft, and the banknote picking up wheel shaft is drivably connected with the banknote separating shaft, such that the banknote picking up wheel may be displaced to pick up banknotes.

Preferably, the driving assembly includes a driving pushing member for driving and supporting the bottom of the banknote picking up wheel bracket, a driving shaft for mounting the driving pushing member and a set of driving parts mounted between the banknote pressing plate driving mechanism and the driving shaft. When the banknote pressing plate driving mechanism moves towards the banknote stacking direction and drives the driving shaft to rotate via the driving parts, the driving pushing member drives the banknote picking up wheel bracket to move towards the banknote holding platform, and the banknote picking up wheel exposes above the banknote holding platform and contacts with the banknotes. Via the driving assembly consisted by the driving pushing member and the driving shaft, the driving assembly is simpler in the structure and may drive and support the bottom of the banknote picking up wheel bracket more reliable; via the above driving assembly, the linked motion between the banknote pressing plate driving mechanism and the driving assembly is realized.

Preferably, a contacting surface of the driving pushing member where slidably contacts with the banknote picking up wheel bracket is non-planar, and a direction of the supporting force acted on the banknote picking up wheel bracket by the driving pushing member is not in line with the gravity direction of the banknote picking up wheel bracket. In particular, the contacting surface of the driving pushing member where slidably contacts with the banknote picking up wheel bracket is an arc-shaped surface. use of the non-planar contacting surface is convenient for the driving pushing member to push the banknote picking up wheel bracket; use of the arc-shaped contacting surface is more convenient for the driving pushing member to push the banknote picking up wheel bracket. The direction of the supporting force acted on the banknote picking up wheel bracket by the driving pushing member is not in line with the gravity direction of the banknote picking up wheel bracket, thereby facilitating the automatic return of the banknote picking up wheel bracket and the banknote picking up wheel.

More particularly, the driving parts include a sliding block provided on the banknote pressing plate driving mechanism and a pushing block provided on the driving shaft and corresponded to the sliding block, such that the driving parts have simple structure and more reliable performance.

The driving parts may include a rack provided on the banknote pressing plate driving mechanism and a gear provided on the driving shaft and corresponded to and engagable with the rack, such that the driving parts may be operated more accurately.

Preferably, a first gear and a second gear are respectively mounted on the banknote picking up wheel shaft and the banknote separating shaft, the first gear and the second gear are drivably connected via a third gear. In this way, the synchronous rotation in the same direction between the banknote picking up wheel shaft and the banknote separating shaft is realized, thereby providing an excellent condition for the cooperating action between the banknote picking up wheel and the banknote separating wheel.

Compared with the prior art, due to the driving assembly in the present application, when there is a need to deposit the banknotes, the banknote picking up mechanism hidden below the banknote holding platform is driven to be exposed above the banknote holding platform and to contact with banknotes so as to pick up the banknotes on the banknote holding platform and transfer the picked banknotes to the banknote separating mechanism; when there is no need to pick up the banknotes, the banknote picking up mechanism is hidden below the banknote holding platform thus the banknote picking up mechanism cannot pick up the banknotes on the banknote holding platform. Therefore, the displacable banknote picking up device according to the present application is capable of depositing a specific number of banknotes to satisfy the individual requirement of the customer on one hand and suspending banknote deposit to ensure the safety of property on the other hand.

DETAILED DESCRIPTION OF THE INVENTION

The technical content and the structural features of the present application will be further described in detail in conjunction with drawings and embodiments as follows.

Figure 1:
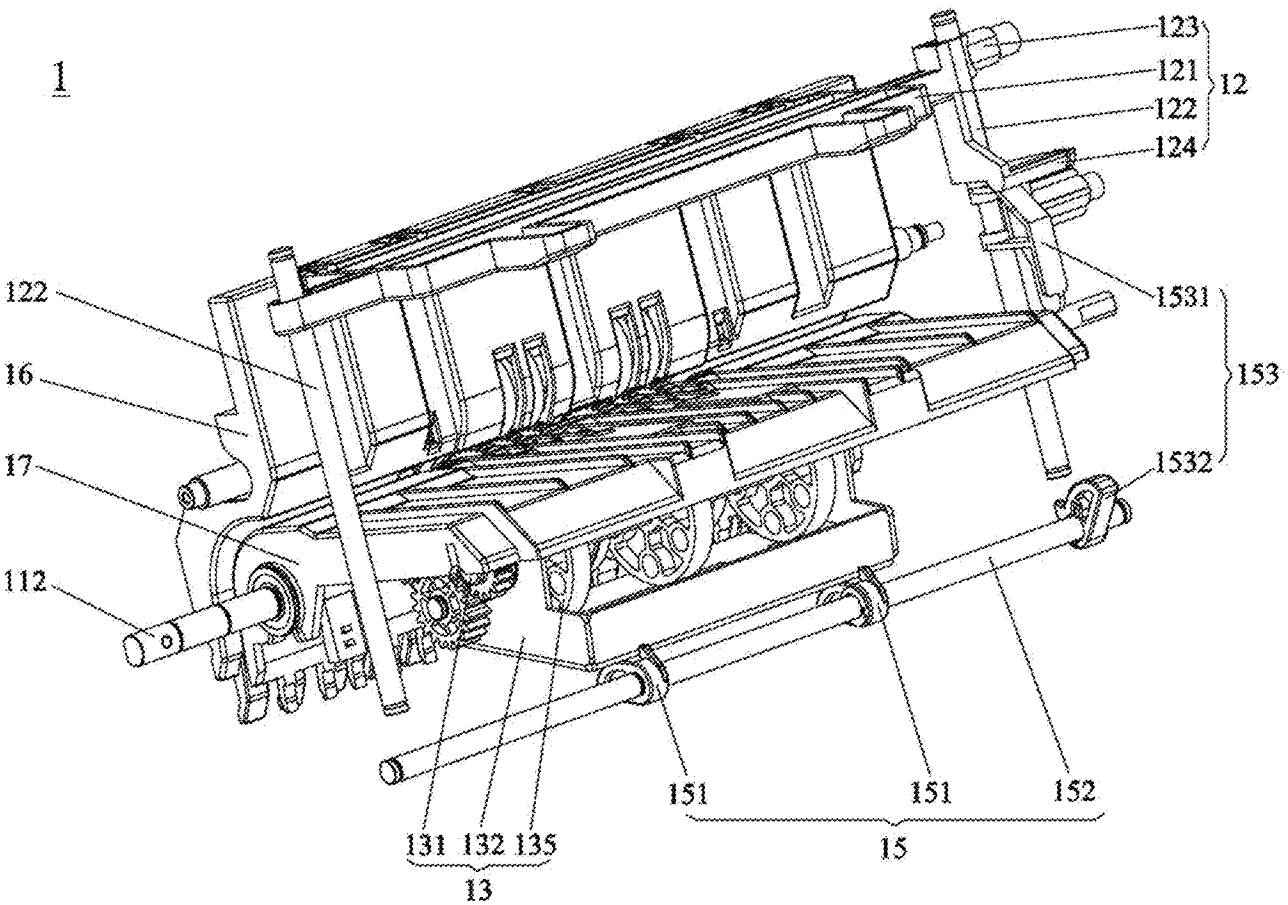
FIG. 1 is a schematic view of the structure of a displacable banknote picking up device according to the present application.
Figure 2:
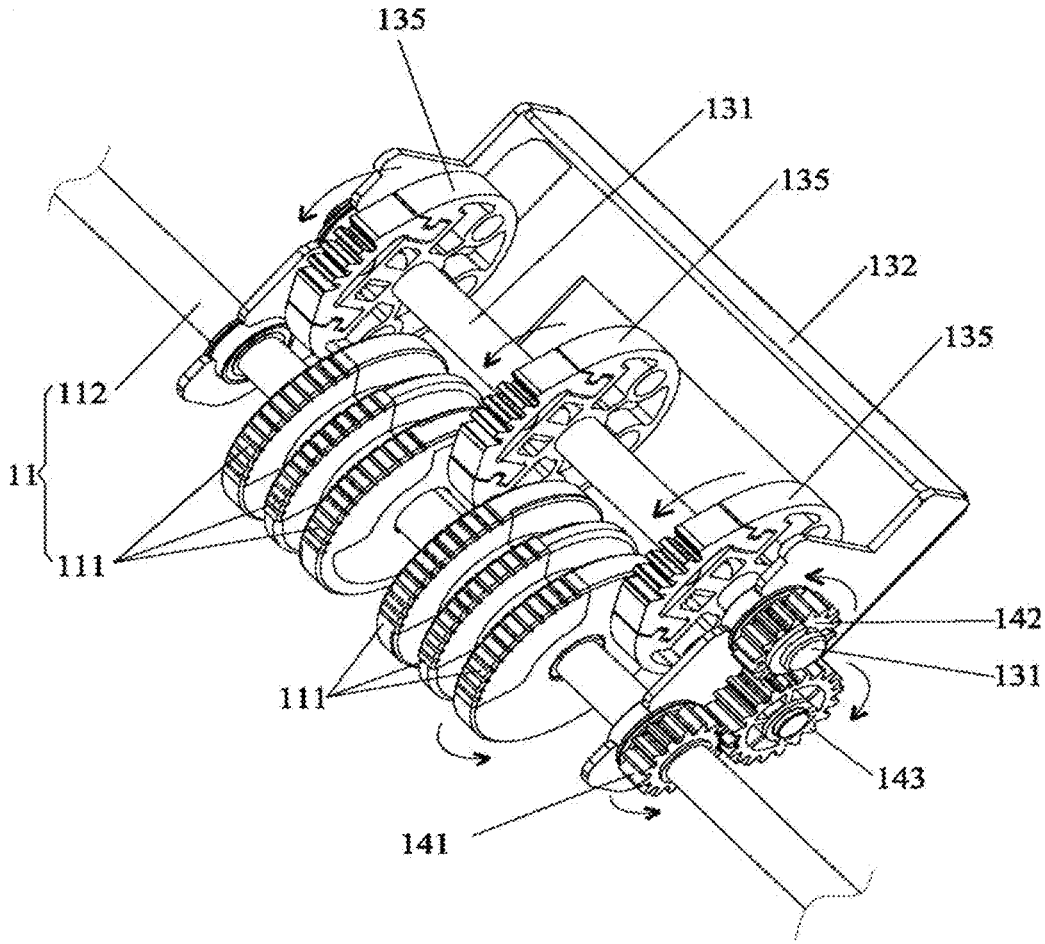
FIG. 2 is a schematic view of the structure of the displacable banknote picking up device according to the present application with a banknote separating mechanism and a banknote picking up mechanism assembled together.

Referring to FIGS. 1 and 2, a displacable banknote picking up device 1 according to the present application may be installed in a self-service equipment which needs to provide functions of depositing a specific number of banknotes and suspending banknote deposit, and can also be installed in other self-service equipment which need to provide functions of depositing a specific number of and suspending deposit of sheet mediums other than the banknotes. The displacable banknote picking up device 1 of the present application includes a banknote holding platform 17, a banknote picking up mechanism 13 for picking up banknotes on the banknote holding platform 17, a banknote separating mechanism 11 for separating the picked banknotes and a driving assembly 15. The banknote holding platform 17 and a fixing bracket 16 are respectively mounted on metal plates at two sides of a banknote outlet. The banknote separating mechanism 11 includes a banknote separating shaft 112 and a banknote separating wheel 111 fixed on the banknote separating shaft 112. The driving assembly 15 drives the banknote picking up mechanism 13 hidden below the banknote holding platform 17 to be exposed above the banknote holding platform 17 and to contact with the banknotes. In order to stack the banknotes on the banknote holding platform 17 more orderly, the displacable banknote picking up device 1 of the present application further includes a banknote pressing mechanism 12 for pressing the banknotes on the banknote holding platform 17.

More particularly, referring to FIGS. 1 and 3-9, the above mentioned banknote pressing mechanism 12 includes a banknote pressing slide shaft 122, a banknote pressing plate 121 slidably provided on the banknote pressing slide shaft 122 and a banknote pressing plate driving mechanism 120 for providing sliding power to the banknote pressing plate 121. One side of the banknote pressing plate 121 extends outwardly to form a rotary column 123 and a spring bracket 124, a spring rotary wheel 125 is pivotably mounted on the rotary column 123, a spring 126 is provided between the banknote pressing plate driving mechanism 120 and the banknote pressing plate 121, and a banknote stacking area 19 for stacking the banknotes is formed between the banknote pressing plate 121 and the banknote holding platform 17. Constituted by the banknote pressing slide shaft 122, the banknote pressing plate 121 and the banknote pressing plate driving mechanism 120, the banknote pressing mechanism 12 has a simpler and more compact structure.

Figure 3:
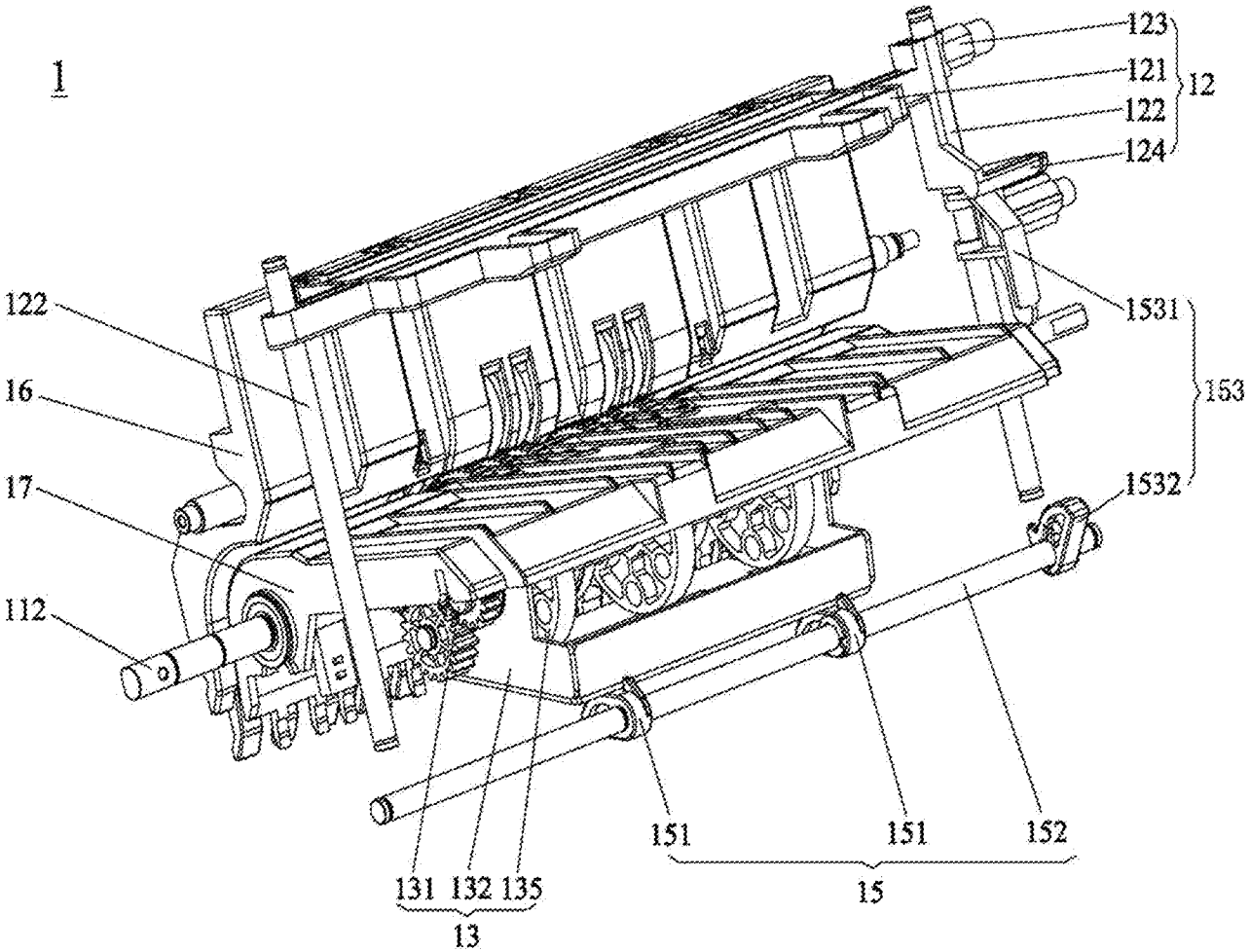
FIG. 3 is a schematic view of the displacable banknote picking up device according to the present application in a banknote deposit suspended state.

Referring to FIGS. 1-3, the banknote picking up mechanism 13 includes a banknote picking up wheel bracket 132, a banknote picking up wheel shaft 131 rotatably connected with the banknote picking up wheel bracket 132 and at least one banknote picking up wheel 135 fixed on the banknote picking up wheel shaft 131. The banknote picking up wheel bracket 132 is rotatably connected with the banknote separating shaft 112, and the banknote picking up wheel shaft 131 is drivably connected with the banknote separating shaft 112. In detail, a first gear 141 is mounted on the banknote separating shaft 112, a second gear 142 is mounted on the banknote picking up wheel shaft 131, and the first gear 141 and second gear 142 are drivably connected via a third gear 143 to realize the synchronous rotation in the same direction of the banknote picking up wheel shaft 131 and the banknote separating shaft 112, thereby providing an excellent condition for the cooperating action between the banknote picking up wheel 135 and the banknote separating wheel 111. Meanwhile, in this embodiment, there are three banknote picking up wheels 135, three banknote separating wheels 111 are provided between every two adjacent banknote picking up wheels 135 to obtain the best banknote picking up and separating performance.

Referring to FIGS. 1 and 3-8, the driving assembly 15 includes a driving pushing member 151 for driving and supporting the bottom of the banknote picking up wheel bracket 132, a driving shaft 152 for mounting the driving pushing member 151 and a set of driving parts 153 mounted between the banknote pressing plate driving mechanism 120 and the driving shaft 152. The driving parts 153 include a sliding block 1531 provided on the banknote pressing plate driving mechanism 120 and a pushing block 1532 provided on the driving shaft 152 and corresponded to the sliding block 1531, thereby enabling the driving parts 153 having simple structure and more reliable performance. The connecting relationship between the sliding block 1531 and the banknote pressing plate driving mechanism 120 is described in detail below in conjunction with FIG. 9.

The sliding block 1531 is slidably provided on the banknote pressing slide shaft 122. The banknote pressing plate driving mechanism 120 includes a motor (not shown), a crank 1201 and a connecting rod 1202. An output shaft 1203 of the motor is connected with one end of the crank 1201, the other end of the crank 1201 is connected with one end of the connecting rod 1202, and the other end of the connecting rod 1202 is rotatably connected with the sliding block 1531. The spring 126 winds around the spring wheel 125, one end of the spring 126 is mounted on the spring bracket 124 and the other end thereof is mounted on the sliding block 1531. When the motor of the banknote pressing plate driving mechanism 120 is operated, the sliding block 1531 is driven by the crank 1201 and the connecting rod 1202 to slide towards the banknote holding platform 17, the banknote pressing plate 121 is driven by the sliding block 1531 in sliding state via the spring 126 to slide along with the sliding of the sliding block 1531. When the sliding block 1531 slides for a certain distance, the sliding block 1531 drives the pushing block 1532 to bring the driving shaft 152 into rotation. The rotating driving shaft 152 drives the banknote picking up wheel bracket 132 via the driving pushing member 151 to move towards the banknote holding platform 17 such that the banknote picking up wheel 135 is exposed above the banknote holding platform 17 and contacts with banknotes. For facilitating the push of the driving pushing member 151 to the banknote picking up wheel bracket 132 and the automatic return of the banknote picking up wheel bracket 132 and the banknote picking up wheel 135, a contacting surface of the driving pushing member 151 where slidably contacts with the banknote picking up wheel bracket 132 is a non-planar surface or a curved surface. In particular, the contacting area of the driving pushing member 151 where slidably contacts with the banknote picking up wheel bracket 132 may even be a straight line parallel to an axis of the driving shaft 153, and the direction of the supporting force acted on the banknote picking up wheel bracket 132 by the driving pushing member 151 is not in line with the gravity direction of the banknote picking up wheel bracket 132. For further facilitating the push of the driving pushing member 151 to the banknote picking up wheel bracket 132, the contacting surface of the driving pushing member 151 where slidably contacts with the banknote picking up wheel bracket 132 is an arc-shaped surface. The driving assembly 15 consisted by the driving pushing member 151 and the driving shaft 152 have a simple structure and is capable of driving and supporting the bottom of the banknote picking up wheel bracket 132 more reliably. Via the above driving parts 153, the linked motion between the banknote pressing plate driving mechanism 120 and the driving assembly 15 is realized.

Figure 4:
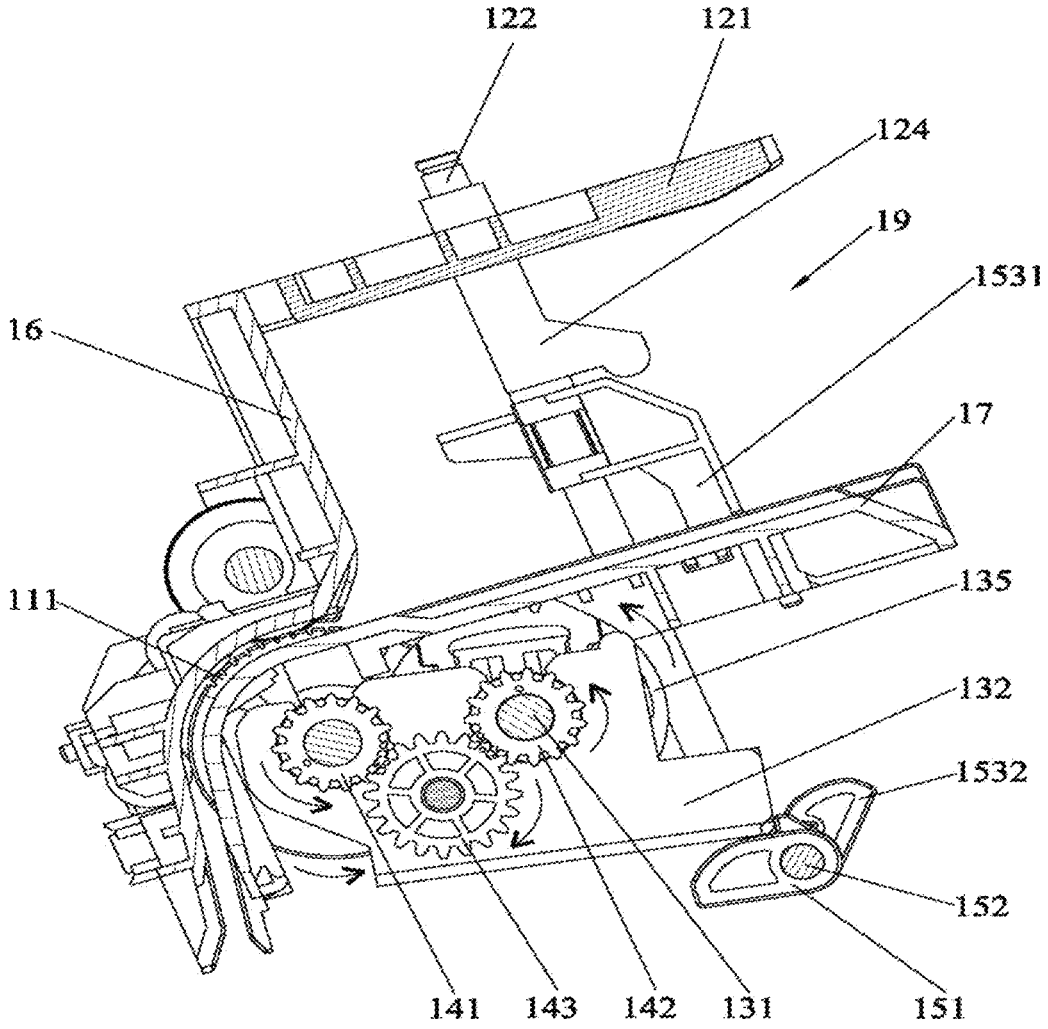
FIG. 4 is a schematic view of the structure of the displacable banknote picking up device in FIG. 3 viewed from one angle.
Figure 5:
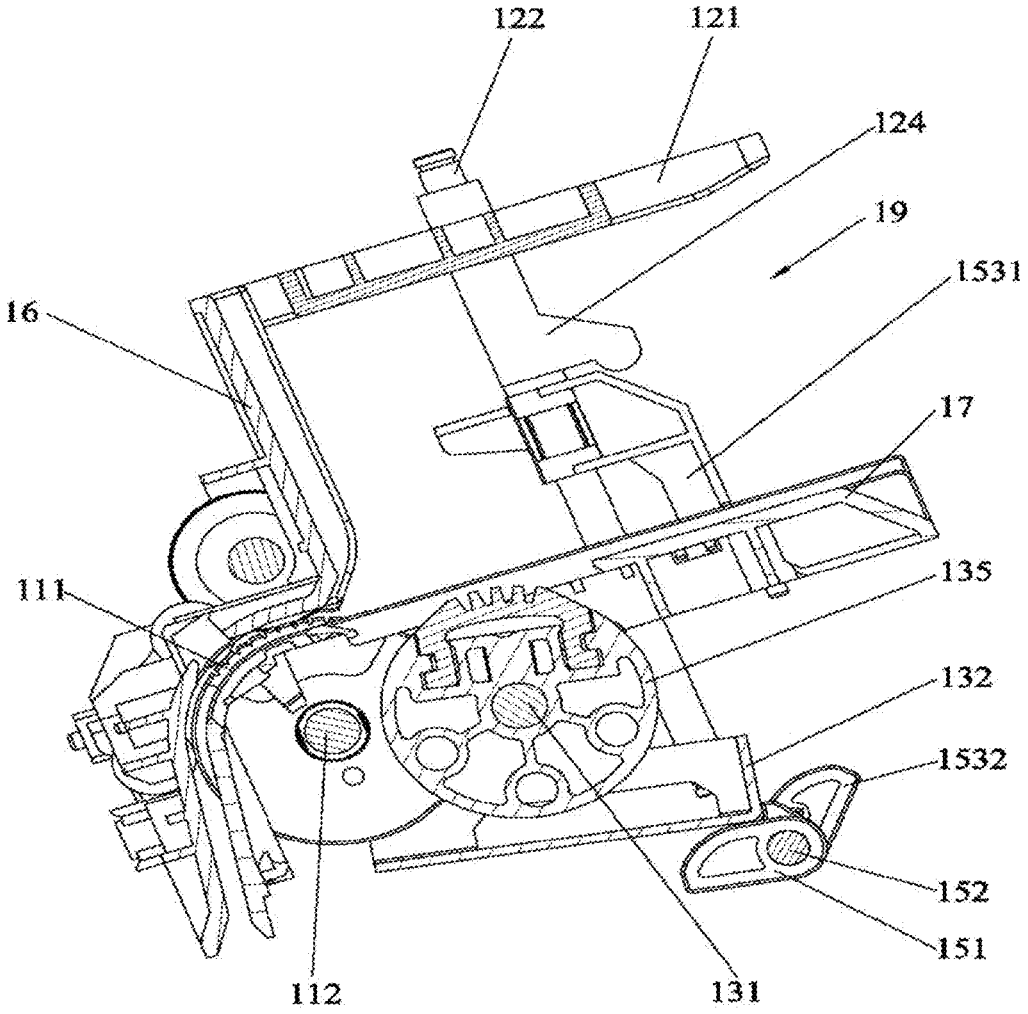
FIG. 5 is a schematic view of the structure of the displacable banknote picking up device in FIG. 3 viewed from another angle.
Figure 6:
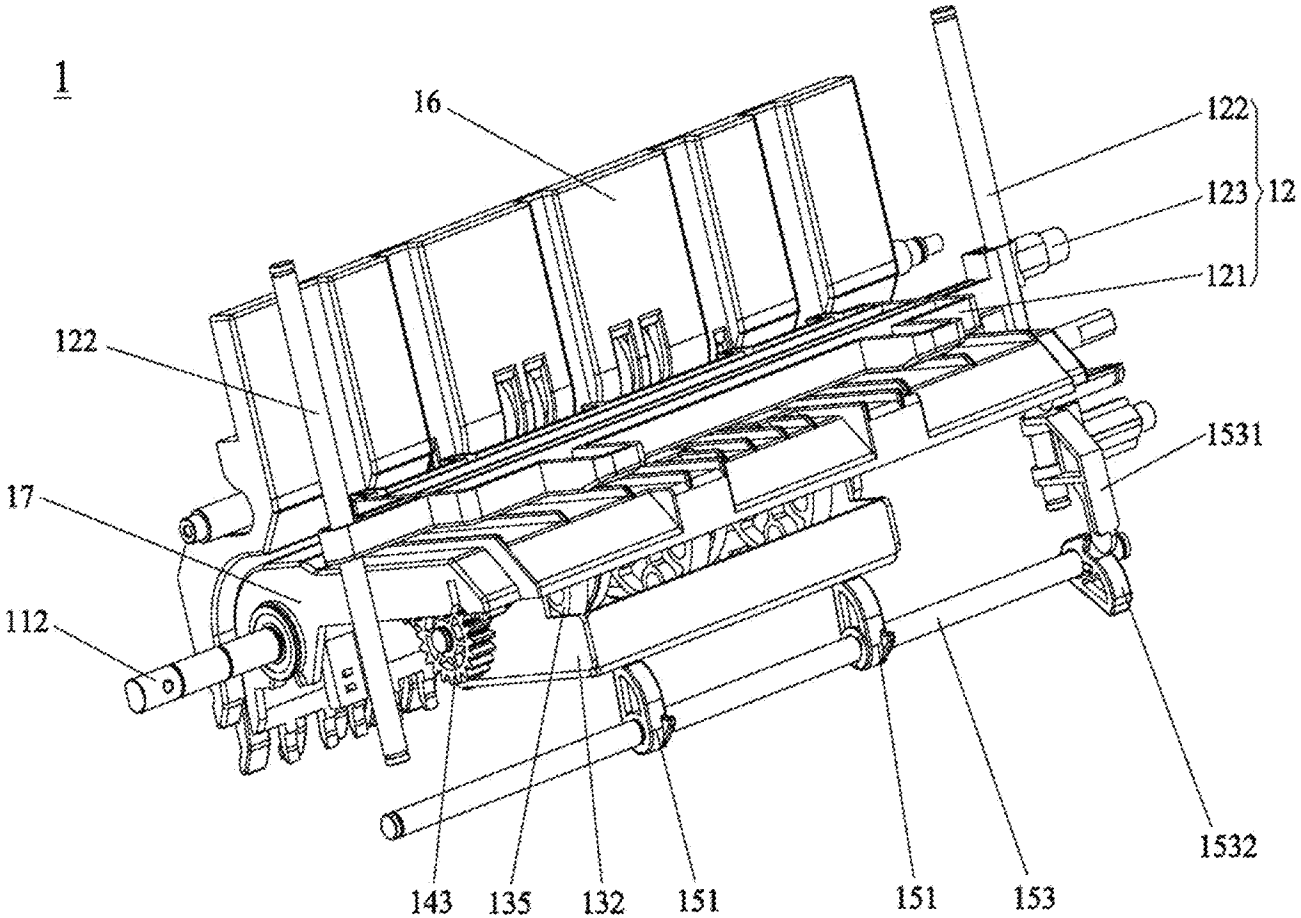
FIG. 6 is a schematic view of the structure of the displacable banknote picking up device according to the present application in a banknote picking up and separating state.
Figure 7:
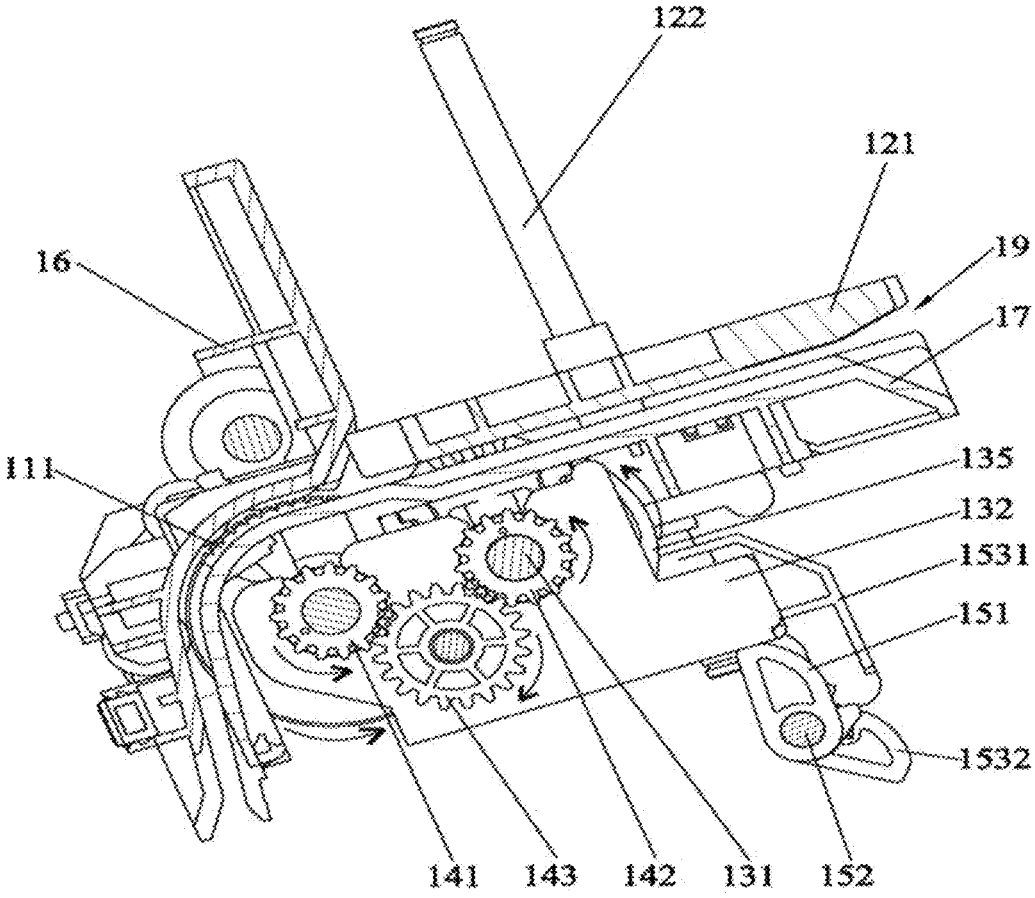
FIG. 7 is a schematic view of the structure of the displacable banknote picking up device in FIG. 6 viewed from one angle.
Figure 8:
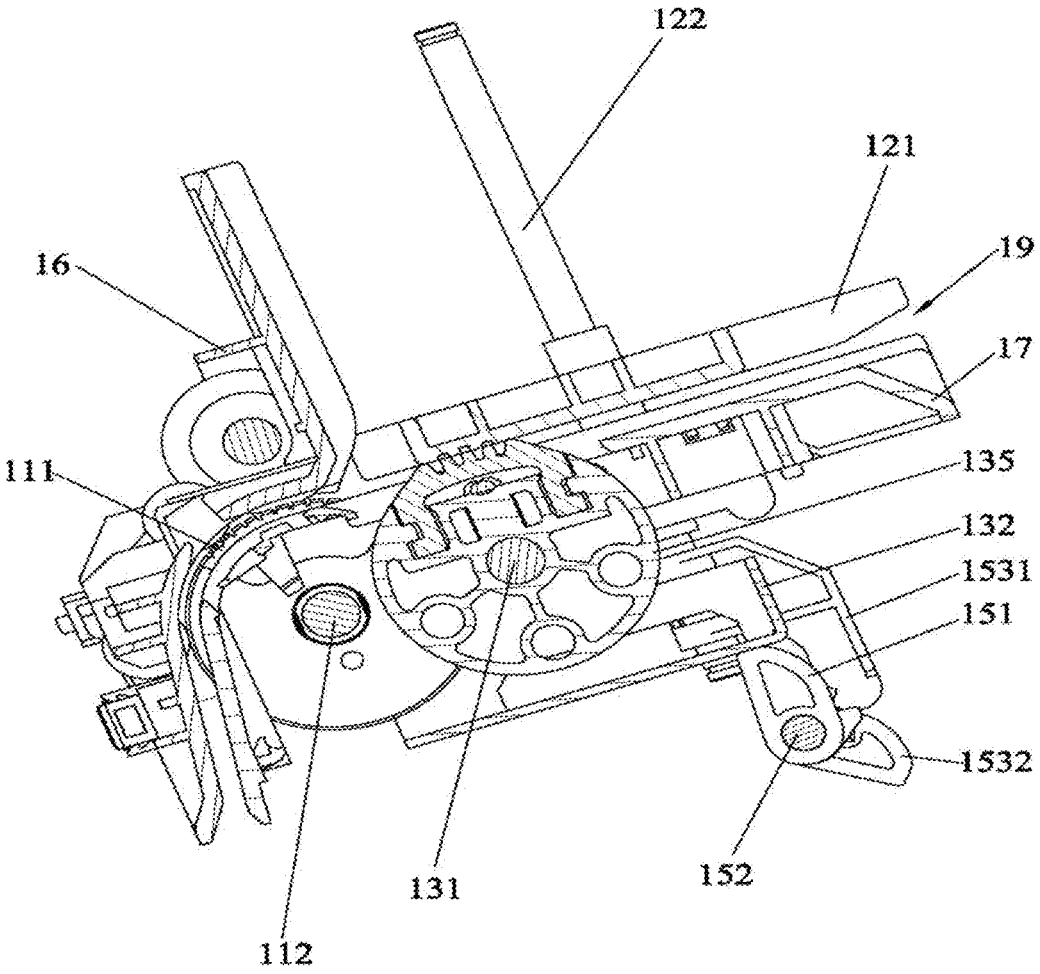
FIG. 8 is a schematic view of the structure of the displacable banknote picking up device in FIG. 6 viewed from another angle.
Figure 9:
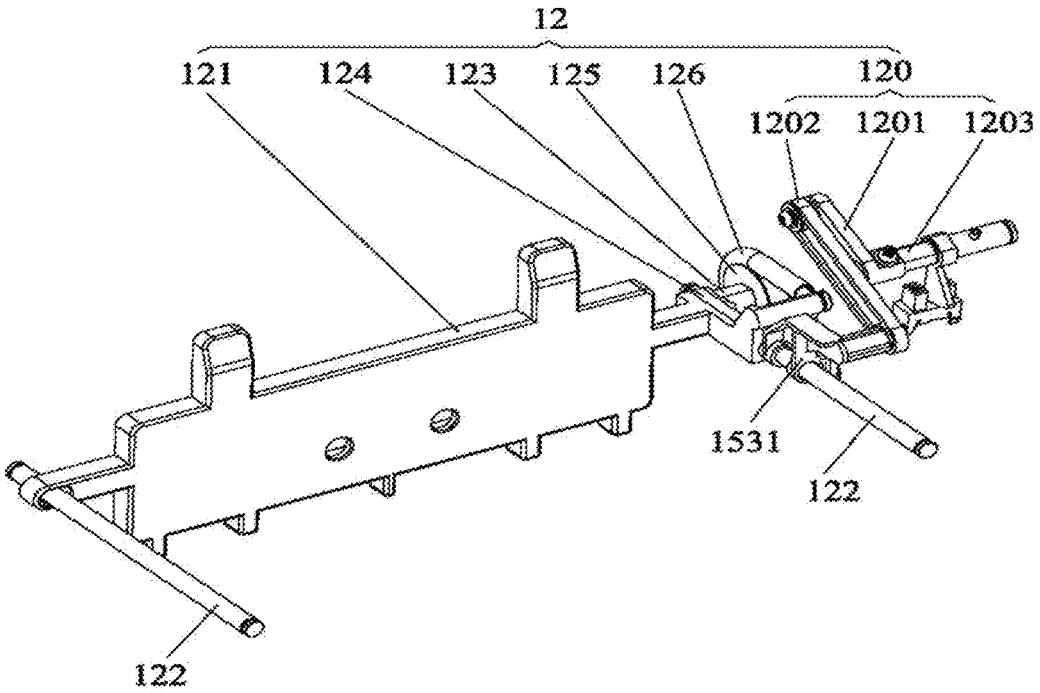
FIG. 9 is a schematic view of the structure of a banknote pressing mechanism of the displacable banknote picking up device according to the present application when driving a sliding block.

The working principle of the displacable banknote picking up device 1 according to the present application is described in detail below in conjunction with the drawings. After the banknotes are put in the banknote stacking area 19 consisted by the banknote holding platform 17 and the banknote pressing plate 121 and the number of the banknotes to be deposited is to specified, the motor of the banknote pressing plate driving mechanism 120 is actuated to drive the sliding block 1531 to slide towards the banknote holding platform 17 via the crank 1201 and the connecting rod 1202. The sliding block 1531 in sliding state pulls the banknote pressing plate 121 via the spring 126 to move towards the banknote holding platform 17 along with the sliding block 1531 so as to enable the banknote pressing plate 121 to press the banknotes. After sliding for a certain distance, the sliding block 1531 pushes the pushing block 1532 to drive the driving shaft 152 to rotate in a clockwise direction in FIG. 7. Via the driving pushing member 151, the rotating driving shaft 152 pushes the banknote picking up wheel bracket 132 to move towards the banknote holding platform 17 and enables the banknote picking up wheel 135 which is mounted on the banknote picking up wheel bracket 132 and hidden below the banknote holding platform 17 to be exposed above the banknote holding platform 17 gradually. With the continued operation of the motor of the banknote pressing plate driving mechanism 120, eventually the sliding block 1531 pushes the pushing block 1532 to drive the driving shaft 152 to rotate to a limit position as shown in FIG. 7, and meanwhile the banknote pressing plate 121 is pressed on one side of the banknotes held by the banknote holding platform 17. At the same time, the banknote picking up wheel bracket 132 is fully lifted by the driving pushing member 151 which enables the banknote picking up wheel 135 hidden below the banknote holding platform 17 to be fully exposed above the banknote holding platform 17 and to contact with the other side of the banknotes, thus preparing for the banknotes deposit. At this moment, the state that the driving pushing member 151 abuts against the banknote picking up wheel bracket 132 and the state that the pushing block 1532 abuts against the sliding block 1531 are shown in FIG. 8. Then, the banknote separating shaft 112 is driven to rotate, the rotating banknote separating shaft 112 drives the banknote separating wheel 111, which is fixed on the banknote separating shaft 112, and the first gear 141 to rotate in a counterclockwise direction in FIG. 7. Via the third gear 143 and the second gear 142, the first gear 141 drives the banknote picking up wheel shaft 131 to rotate along with the banknote separating shaft 112 synchronously and in the same direction, thereby eventually enabling the banknote picking up wheel 135 to rotate synchronously and in the same direction with the banknote separating wheel 111, and enabling the banknote picking up wheel 135 and to the banknote separating wheel 111 to pick up and separate banknotes orderly. At this moment, the rotating directions of the banknote picking up wheel 135, the banknote separating wheel 111, the first gear 141, the second gear 142 and the third gear 143 are shown in FIGS. 2, 4 and 7. When the last piece of banknotes in the specific number of banknotes to be deposited is picked up by the banknote picking up wheel 135 and is transferred to the banknote separating wheel 111, the motor of the banknote pressing plate driving mechanism 120 drives the sliding block 1531 via the crank 1201 and the connecting rod 1202 to slide back away from the banknote holding platform 17, the returned sliding block 1531 drives the banknote pressing plate 121 to be returned together. Meanwhile, the returned sliding block 1531 is no longer press the pushing block 1532, due to the weights of the banknote picking up wheel bracket 132 and the banknote picking up wheel 135 mounted thereon, the driving pushing member 151 is driven to rotate about the driving shaft 152 in FIG. 4 in a counterclockwise direction and then to be returned along with the return of the banknote picking up wheel bracket 132. The returned banknote picking up wheel bracket 132 enables the banknote picking up wheel 135 to be hidden below the banknote holding platform 17 (as shown in FIG. 5), while in above process the banknote separating shaft 112 is still working, thus when the banknote picking up wheel 135 cannot pick up the banknotes in the banknote stacking area 19, the banknote separating wheel 111 can still transfer the last piece of banknote transferred from the banknote picking up wheel 135 to a specific location. In this way, the displacable banknote picking up device 1 of the present application has the functions of depositing a specific number of banknotes and suspending banknote deposit. At this moment, the rotating directions of the banknote separating wheel 111, the first gear 141, the second gear 142, the third gear 143 and the banknote picking up wheel 135 are indicated by the arrows in FIG. 4, and the position between the banknote picking up wheel bracket 132 and driving pushing member 151 and the position between the sliding block 1531 and the pushing block 1532 are as shown in FIG. 5.

When there is a need to deposit the banknotes, the driving assembly 15 according to the present invention drives the banknote picking up mechanism 13 hidden below the banknote holding platform 17 to be exposed above the banknote holding platform 17 and to contact with banknotes so as to pick up the banknotes on the banknote holding platform 17 and transfer the to picked up banknotes to the banknote separating mechanism 11 for separating; when there is no need to pick up the banknotes, via the driving assembly 15, the banknote picking up mechanism 13 is hidden below the banknote holding platform 17 thus the banknote picking up mechanism 13 cannot pick up the banknotes on the banknote holding platform 17. Therefore, the displacable banknote picking up device 1 according to the present application is capable of depositing a specific number of banknotes to satisfy the individual requirement of the customer on one hand and suspending banknote deposit to ensure the safety of property on the other hand.

The above disclosure is only preferred embodiments of the present application, and should not be used to limit the protection scope of the present application, thus any equivalent modifications made according to the claims of the present application also fall into the protection scope of the present application.

What is claimed is:

1. A displaceable banknote picking up device provided in a banknote inlet of a banknote processing device, comprising a banknote holding platform, a banknote picking up mechanism for picking up banknotes on the banknote holding platform and a banknote separating mechanism for separating the picked banknotes, the banknote separating mechanism comprising a banknote separating shaft and a banknote separating wheel fixed on the banknote separating shaft, wherein the displaceable banknote picking up device further comprises a driving assembly for driving the banknote picking up mechanism hidden below the banknote holding platform to be exposed above the banknote holding platform and to contact with the banknotes;

the displaceable banknote picking up device further comprises a banknote pressing mechanism for pressing the banknotes on the banknote holding platform;

the banknote pressing mechanism comprises a banknote pressing slide shaft, a banknote pressing plate slidably provided on the banknote pressing slide shaft and a banknote pressing plate driving mechanism for providing sliding power to the banknote pressing plate;

the banknote picking up mechanism comprises a banknote picking up wheel bracket, a banknote picking up wheel shaft rotatably connected with the banknote picking up wheel bracket and at least one banknote picking up wheel fixed on the banknote picking up wheel shaft, the banknote picking up wheel bracket is rotatably connected with the banknote separating shaft, and the banknote picking up wheel shaft is drivably connected with the banknote separating shaft; and the driving assembly comprises a driving pushing member for driving and supporting a bottom of the banknote picking up wheel bracket, a driving shaft for mounting the driving pushing member and a set of driving parts mounted between the banknote pressing plate driving mechanism and the driving shaft, when the banknote pressing plate driving mechanism moves towards the banknote stacking direction and drives the driving shaft to rotate via the driving parts, the driving pushing member drives the banknote picking up wheel bracket to move towards the banknote holding platform and the banknote picking up wheel exposes above the banknote holding platform and contacts with the banknotes.

2. The displaceable banknote picking up device according to claim 1, wherein a contacting surface of the driving pushing member which slidably contacts with the banknote picking up wheel bracket is non-planar, and a direction of a supporting force acted on the banknote picking up wheel bracket by the driving pushing member is not in line with a gravity direction of the banknote picking up wheel bracket.

3. The displaceable banknote picking up device according to claim 1, wherein a contacting surface of the driving pushing member which slidably contacts with the banknote picking up wheel bracket is an arc-shaped surface.

4. The displaceable banknote picking up device according to claim 1, wherein the driving parts include a sliding block provided on the banknote pressing plate driving mechanism and a pushing block provided on the driving shaft and corresponded to the sliding block.

5. The displaceable banknote picking up device according to claim 1, wherein a first gear and a second gear are respectively mounted on the banknote picking up wheel shaft and the banknote separating shaft, the first gear and the second gear are drivably connected via a third gear.

6. The displaceable banknote picking up device according to claim 2, wherein the contacting surface of the driving pushing member which slidably contacts with the banknote picking up wheel bracket is an arc-shaped surface.

* * * * *